United States Patent [19]

Franzoni

[11] Patent Number: 4,821,951

[45] Date of Patent: Apr. 18, 1989

[54] CASE FOR AUTOMATICALLY PACKAGING ELONGATE PASTA PRODUCTS THEREIN

[76] Inventor: Arnaldo Franzoni, V.le Riccardo Barilla, 3/A, 43100 Parma, Italy

[21] Appl. No.: 24,135

[22] Filed: Mar. 11, 1987

[51] Int. Cl.[4] ..... B65D 5/42

[52] U.S. Cl. ..... 229/162; 206/45.31

[58] Field of Search ..... 229/162; 206/45.31, 206/45.34

[56] References Cited

U.S. PATENT DOCUMENTS

| | | | |
|---|---|---|---|
| 2,924,371 | 2/1960 | Frankenstein | 229/162 |
| 3,019,958 | 2/1962 | Asman et al. | 229/162 |
| 3,161,288 | 12/1964 | Wagner | 206/45.31 |
| 3,245,526 | 4/1966 | Palmer | 229/162 |
| 3,368,734 | 2/1968 | Wainberg | 229/162 |
| 3,690,523 | 9/1972 | Link | 229/162 |
| 3,835,988 | 9/1974 | Buttery | 229/162 |
| 3,949,868 | 4/1976 | Allen | 206/45.34 |
| 4,182,224 | 1/1980 | Dutcher | 229/162 |

FOREIGN PATENT DOCUMENTS

| | | | |
|---|---|---|---|
| 1010556 | 11/1965 | United Kingdom | 206/45.31 |

*Primary Examiner*—Stephen Marcus
*Assistant Examiner*—Gary E. Elkins
*Attorney, Agent, or Firm*—Saidman, Sterne, Kessler & Goldstein

[57] ABSTRACT

A packaging case for elongate pasta products, specifically spaghetti pasta products, has a sidewall formed with a window closed by a clear sheet pasted to both the sidewall and that closure flap which corresponds to the sidewall, thereby favoring, once displayed outwards, automated filling of the packaging case and preventing equipment jamming.

1 Claim, 1 Drawing Sheet

CASE FOR AUTOMATICALLY PACKAGING ELONGATE PASTA PRODUCTS THEREIN

This invention relates to a case for automatically packaging elongate pasta products therein, being of a type which comprises a die-cutting wherein there are defined sidewalls for said case and closure flaps therefor which extend from opposed sides of said sidewalls, one of said sidewalls being formed with a window closed by a clear sheet.

More particularly, this invention relates to a case intended to contain "spaghetti" pasta products automatically packaged therein.

It has been found in recent times that food products packaged in cases provided with an inspection window are gaining increasingly more favorable acceptance by the consumer public. the window enables the consumer to inspect the contents of the case or package directly, before deciding in favor of its purchase.

Also currently available commercially for pasta products are cases which comprise, in a manner known in the art, a die-cutting from a paper material having fold lines which lie in accordance with a developed parallelepipedon with a sidewall formed with a small window. The window is usually closed by means of a sheet or film of a clear material. In order to apply said clear sheet in an automated fashion, a continuous bead, forming essentially a framing pattern, of a cement is laid all around the peripheral edge of the window at some distance therefrom, thereafter the clear sheet is applied and pressed down. For the sheet application to be successful, the sheet is provided to a larger size than that of the cement framing pattern, thereby after completion of the sheet application process, a peripheral skirt of the clear sheet is left unrestrained, i.e. unpasted to the die-cutting wall.

In as case formed from such a die-cutting, the aforesaid clear sheet would be left on the interior thereof, in contact relationship with its spaghetti contents.

On the occasion of a case as indicated being filled with spaghetti pasta products, it may happen that one of said spaghettis lodges in between said unrestrained skirt of the clear sheet and the case wall, thus hindering or interfering with the passage of more spaghettis.

This problem practically makes it impossible to package elongate pasta products (such as spaghettis or the like) in an automated manner in such prior cases, because equipment jamming would occur at an unacceptably frequent rate.

The technical problem underlying this invention is to provide a case for automatically packaging elongate pasta products therein, which has such constructional and operational features as to obviate the above-outlined shortcoming.

This problem is solved by a case as specified above being characterized in that said clear sheet is attached to both said sidewall and one of said closure flaps extending out of said sidewall.

Further features and the advantages of the inventive case may be appreciated from the following detailed description of an exemplary embodiment thereof, as given by way of illustration and not of limitation with reference to the accompanying drawing.

Figure 2:
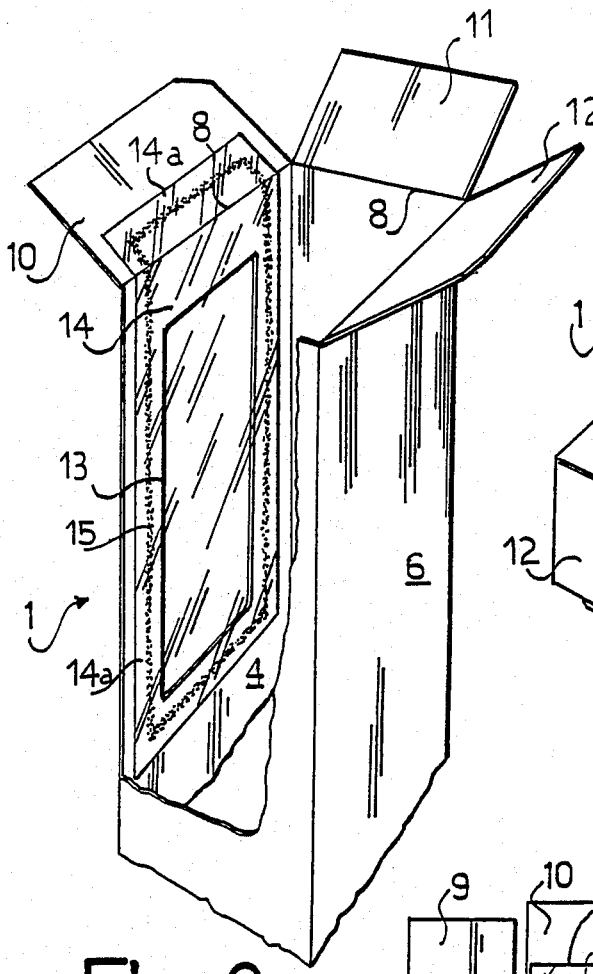
FIG. 2 shows a perspective view of the case of FIG. 1, in the open condition thereof.
Figure 1:
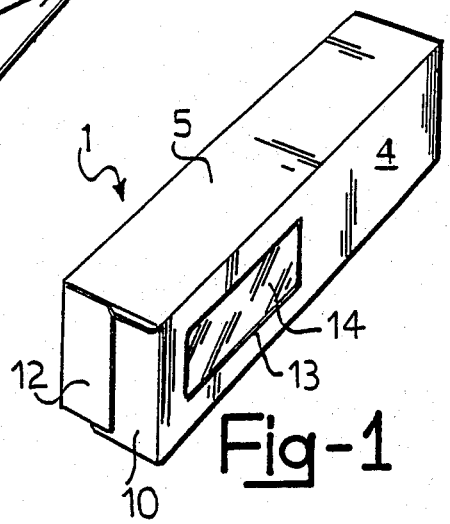
FIG. 1 shows a perspective view of a case for elongate pasta products according to this invention.
Figure 3:
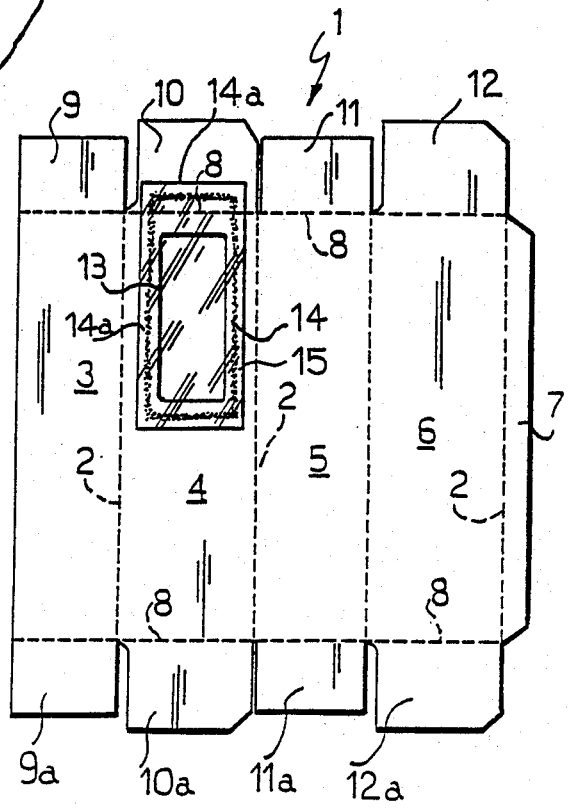
FIG. 3 shows a flat developed view of the die-cutting which forms the blank for a case as shown in FIG. 1.

With reference to the drawing figures, generally indicated at 1 is a case according to the invention which is adapted for packaging elongate pasta products, such as "spaghettis" in an automated manner therein.

The case 1 comprises a die-cutting from a paper-based material wherein conventional fold lines, indicated at 2 and 8, define sidewalls 3,4,5 and 6 for the case 1, as well as closure flaps 9,10,11,12 and 9*a*,10*a*,11*a*,12*a* which extend from opposed sides of said walls.

Through the sidewall 4, there is formed a rectangular window 13, the major side whereof extends lengthwise to the wall 4, whilst its minor side extends proximately to the closure flap 10 at a set distance from the fold line 8.

The window 13 is closed by means of a sheet 14 of a clear material being pasted to the inner wall 4 of the case 1 and to the flap 10.

More specifically, in order to apply the sheet 14 in an automated manner, a cement bead 15 is laid on the wall 4 in the proximities of three contiguous sides of the rectangular window 13 (leaving out that side of the window which extends adjacent the fold line 8), and on the flap 10, thus forming on the whole a rectangular framing pattern crossed by the fold line 8. Thereafter, on said bead 15 of cement, the sheet 14 is applied and pressed down whose dimensions exceed those of the cement bead framing pattern, thereby an unrestrained peripheral skirt 14*a* is formed in said sheet 14.

At the time of introducing spaghettis into the case 1 of this invention, the flaps 9,10,11 and 12 thereof would be set in an ourwardly splayed attitude. Also outwardly splayed would be, accordingly, that portion of the clear sheet which has been pasted to the flap 10. As a result, the unrestrained skirt 14a of that clear sheet portion cannot interfere with the spaghetti filling operation, it being held away from their path.

The packaging case of this invention affords the important advantage of enabling elongate pasta products, specifically spaghetti pasta products, to be packaged on automated equipment, and that such packaging operation can now be incorporated to an industrial production cycle as a final step thereof.

I claim:

1. A case for automatically packaging elongate pasta products therein, of a type which comprises:

a die cutting wherein there are defined, as by fold lines, sidewalls for said case and closure flaps therefor extending from opposed sides of said sidewalls, a window formed in a first one of said sidewalls, a clear sheet attached to only said first sidewall and to only one adjacent closure flap which extends from said first sidewall, a cement bead laid on said sidewall in proximity of said window and on said flap forming a continuous rectangular pattern crossed by a fold line extending between said sidewall and said flap, said clear sheet having dimensions exceeding said pattern thereby forming an unrestrained peripheral skirt, wherein said flap can be outwardly splayed relative to said sidewall when said case is assembled to prevent said clear sheet and said unrestrained peripheral skirt from interfering with operations for filling said case, wherein said fold lines are positioned so as to form an elongated rectangular box having a window on one sidewall when said die cutting is folded along said fold lines.

* * * * *

UNITED STATES PATENT AND TRADEMARK OFFICE

CERTIFICATE OF CORRECTION

PATENT NO. : 4,821,951

DATED : April 18, 1989

INVENTOR(S) : Arnaldo Franzoni

It is certified that error appears in the above-identified patent and that said Letters Patent is hereby corrected as shown below:

On the face of the patent below the filing date, insert
--[30] Foreign Application Priority Data
Dec. 1, 1986 [IT] Italy .....22525-A/86--

Signed and Sealed this

Fourteenth Day of November, 1989

*Attest:*

JEFFREY M. SAMUELS

*Attesting Officer* *Acting Commissioner of Patents and Trademarks*